US007923671B1

(12) United States Patent
Huguenin et al.

(10) Patent No.: US 7,923,671 B1
(45) Date of Patent: Apr. 12, 2011

(54) DRIVE DEVICE FOR PROJECTILE FINS

(75) Inventors: Simon Huguenin, Bourges (FR); Richard Roy, Bourges (FR)

(73) Assignee: Nexter Munitions, Versailles (FR)

( * ) Notice: Subject to any disclaimer, the term of this patent is extended or adjusted under 35 U.S.C. 154(b) by 929 days.

(21) Appl. No.: 11/528,377

(22) Filed: Sep. 28, 2006

(30) Foreign Application Priority Data

Oct. 5, 2005 (FR) ..... 05 10164

(51) Int. Cl.
*F42B 10/64* (2006.01)
*F42B 10/14* (2006.01)

(52) U.S. Cl. ..... 244/3.24

(58) Field of Classification Search ..... 244/3.24, 244/3.28, 3.29
See application file for complete search history.

(56) References Cited

U.S. PATENT DOCUMENTS 4,709,877 A * 12/1987 Goulding ..... 244/3.28
5,048,772 A 9/1991 Wisshaupt ..... 244/3.23
5,505,408 A * 4/1996 Speicher et al. ..... 244/52
5,630,564 A * 5/1997 Speicher et al. ..... 244/3.24
5,806,791 A * 9/1998 Hatalsky et al. ..... 244/3.24
5,823,469 A * 10/1998 Arkhangelsky et al. ..... 244/3.22
6,073,880 A * 6/2000 Voigt et al. ..... 244/3.28
6,186,443 B1 * 2/2001 Shaffer ..... 244/49
6,247,666 B1 * 6/2001 Baker et al. ..... 244/3.21
6,325,325 B1 * 12/2001 Bonnet et al. ..... 244/3.24
6,637,699 B2 * 10/2003 Banks et al. ..... 244/3.21
6,827,310 B1 * 12/2004 Whitham ..... 244/3.24
7,175,131 B2 * 2/2007 Dodu et al. ..... 244/3.24
7,219,579 B2 * 5/2007 Turner ..... 74/665 N
7,246,539 B2 * 7/2007 Turner ..... 74/665 N
2008/0029641 A1 * 2/2008 Carlson et al. ..... 244/3.24

FOREIGN PATENT DOCUMENTS

GB 2 374 055 10/2002
WO WO 02/18867 3/2002

* cited by examiner

*Primary Examiner* — Timothy D Collins
*Assistant Examiner* — Joseph W Sanderson
(74) *Attorney, Agent, or Firm* — Steptoe & Johnson LLP

(57) ABSTRACT

A device for driving in rotation fins of a projectile, the fins being of the deployable type integral with fin heads which are able to be oriented along an axis of spin (X, Y) substantially orthogonal to a projectile's longitudinal axis (Z), wherein the fin heads are driven in rotation by motors and substantially ring sector-shaped sliders which slide in a circular groove.

9 Claims, 5 Drawing Sheets

DRIVE DEVICE FOR PROJECTILE FINS

BACKGROUND OF THE INVENTION

1. Field of Invention

The technical scope of the present invention is that of devices to control projectile fins, that is devices which, by the action of a motor, enable deployed fins to be pivoted.

2. Description of Related Art

Fins act as stabilizers for a projectile but may also play a role in piloting, similar to the elevons or ailerons of an aircraft, controlled in rotation by a motor piloted by an electronic system. The piloting of the projectile enables its trajectory to be corrected in flight to rectify any launching errors or to orient it towards a target after said target's detection.

Such fins suffer from the principal drawback of needing to be of a large size if they are to be effective (the length of the fin is usually around one caliber), which makes it impossible for the projectile to be fired from a cannon of the same caliber. Thus, for many years, different mechanisms have been developed to deploy fins and elevons. The projectile fitted with such a mechanism may be a missile, a rocket, or sub-projectile. Thus, French patents FR-2864613 and FR-2846079 describe devices to deploy projectile fins and lock them in their deployed position.

Once the fins have been deployed a further mechanism must be provided to enable them to be oriented.

French Patent FR-2846080 describes a device to deploy and pilot projectile fins. The device disclosed in that document enables the simultaneous orientation of pairs of fins integral with a common control shaft. The main advantage of this device lies in its use of only two motors to orient the four fins.

Despite being particularly effective and judicious in design, that device has one major drawback, Indeed, the positioning of the drive motors for the fins and the numerous parts implemented make it particularly voluminous and sensitive to accelerations, namely when the projectile is being fired.

SUMMARY OF THE INVENTION

The aim of the present invention is to supply a drive device for deployable fins of a projectile, such device being compact and able to withstand the accelerations experienced during firing of a projectile.

The invention thus relates to a device to drive in rotation fins of a projectile, the fins being of the deployable type integral with fin heads, such device incorporating motors and a body with respect to which said fin heads can be oriented along an axis of spin substantially orthogonal to the projectile's longitudinal (Z) axis, wherein the body incorporates a circular groove in which the fin heads are driven in rotation by the motors by means of substantially ring portion shaped sliders which slide in the circular groove.

According to another characteristic of the invention, the sliders slide in a plane that is orthogonal to the longitudinal projectile axis.

According to yet another characteristic of the invention, each slider incorporates a notch and an arm integral with the drive shaft of a motor cooperating with the notch to make the sliders slide in the groove.

According to another characteristic of the invention, each slider incorporates a portion of a rack gear onto which meshes a pinion gear integral with the drive shaft of a motor.

According to another characteristic of the invention, each slider incorporates a hole cooperating with a finger integral with a fin head to make it pivot.

According to another characteristic of the invention, the end of the finger cooperating with the slider is in the form of a spherical head.

According to another characteristic of the invention, the drive motors for the fins are positioned with their axes of rotation substantially parallel to the longitudinal projectile axis.

According to another characteristic of the invention, the motors are evenly spaced angularly around the longitudinal projectile axis.

According to another characteristic of the invention, the motors are positioned angularly in pairs, one motor of each pair on each side of each of opposing fins.

According to another characteristic of the invention, the motors are positioned in pairs in an angular quadrant between two fins.

A first advantage of the device according to the invention lies in the fact that it effectively withstands the accelerations due to the projectile being fired.

Another advantage of the device lies in the fact that it enables different configurations of the angular positioning of the fin drive motors.

Another advantage of the device lies in its compactness and in the manufacturing simplicity of its constituent parts.

BRIEF DESCRIPTION OF THE DRAWINGS

Other characteristics, particulars and advantages of the invention will become more apparent from the description given hereafter by way of illustration and in reference to the drawings, in which.

DETAILED DESCRIPTION OF PREFERRED EMBODIMENTS

Figure 1:
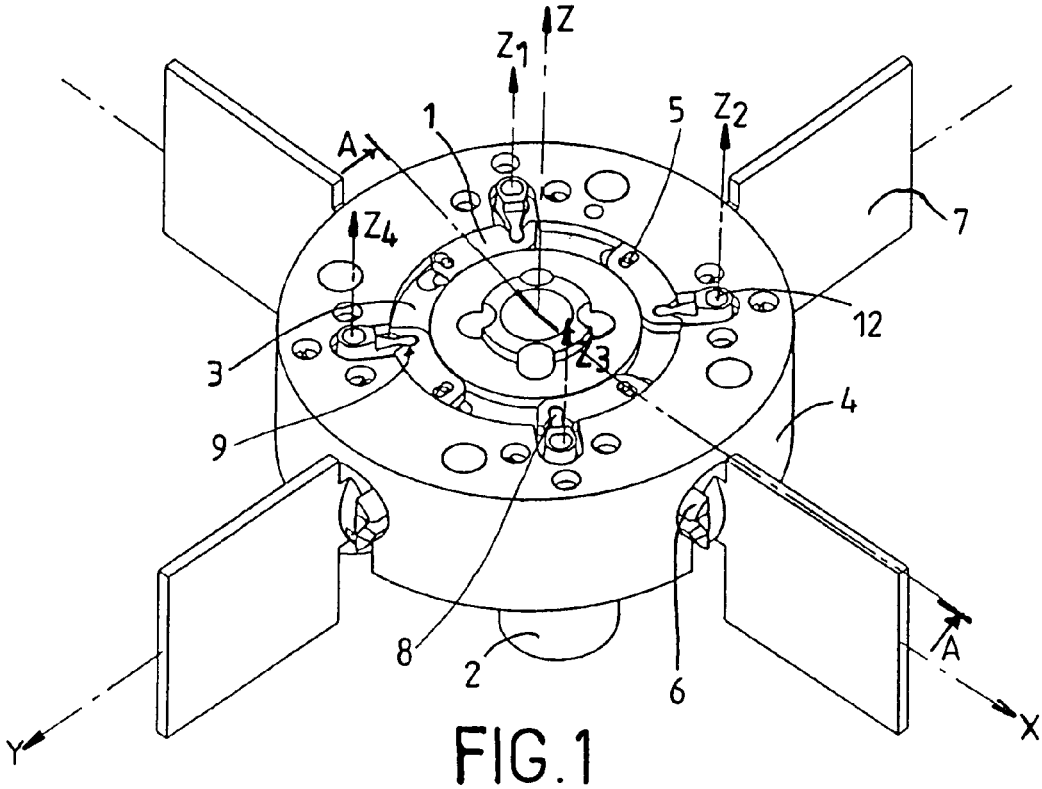
FIGS. 1 and 2 show a perspective view of a fin rotation drive device according to the invention.

FIG. 1 shows a perspective view of a projectile fin rotation drive device according to the invention. For the purposes of clarity, the fin drive device is here shown outside of a projectile body (not shown) and in a configuration in which the fins are deployed and substantially parallel to longitudinal axis Z of the projectile.

Figure 2:
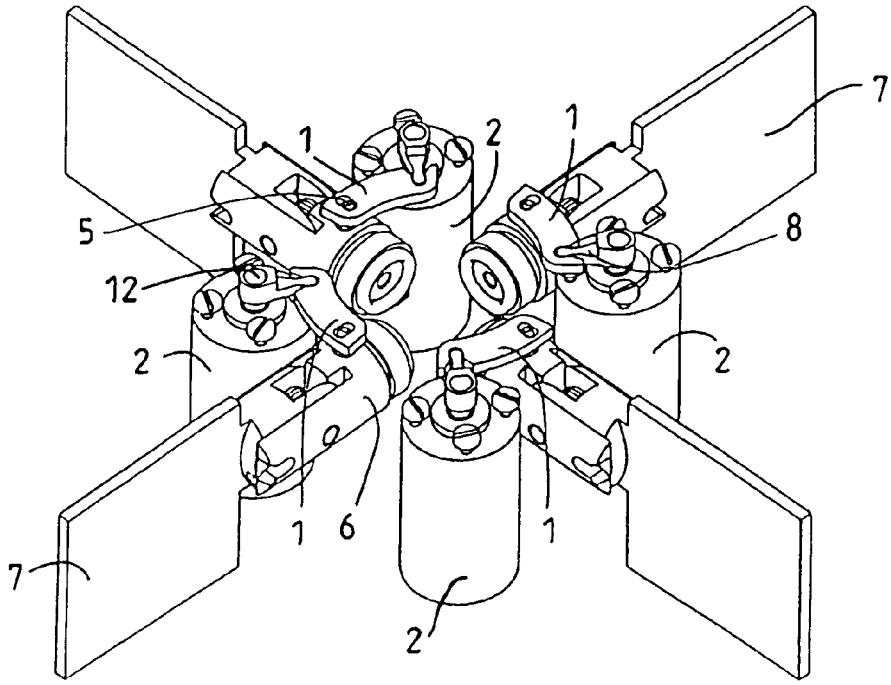

FIG. 2 is the same view of the same embodiments of the invention as shown in FIG. 1 but wherein, for the purposes of improved comprehension of the invention, the body 4 has not been shown.

The fin rotation drive device includes a body 4, sliders 1, motors 2 and fin heads 6 connected with fins 7. The fin heads 6 may be oriented along an axis of spin (respectively, X and Y) orthogonal to longitudinal axis Z of the projectile. The motors 2 are evenly spaced angularly around longitudinal axis Z of the projectile and each includes a drive shaft 12, with an axis of spin ($Z_1$, $Z_2$, $Z_3$ and $Z_4$) parallel to longitudinal axis Z of the projectile. The body 4 incorporates a circular groove 3 in which the sliders 1 are inserted and are able to slide following a circular trajectory around axis Z. The sliders 1 are substantially in the shape of a ring portion or sector and incorporate a hole 11 at one end (which can be seen in FIG. 3) and a notch 9 at the other end. Each fin head 6 is connected to a slider 1 by a finger 5 connected with the fin head 6 and cooperating with the hole 11 in the slider 1. Each motor 2 is connected to a slider 1 by an arm 8, connected with the drive shaft 12 of the motor and cooperating with the notch 9 in the slider 1.

Figure 3:
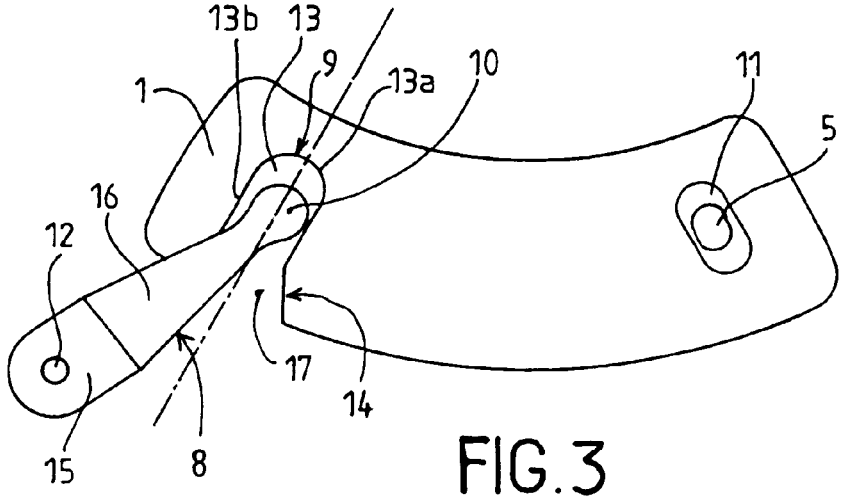
FIG. 3 is a top view of a slider.

FIG. 3 is a top view of a slide.

The slider is substantially in the shape of a ring sector or portion. The notch 9 has a first portion 13 that is substantially oblong and radial with respect to the curvature of the slider and a second outwardly opening portion 17 delimited by two oblique planes 14 opposite one another. The notch 9 is symmetrical with respect to a radial axis of the slider and ends with a cylindrical portion 13*a*. The oblong portion 13 of the notch is also delimited by two parallel planes 13*b*. The arm 8 cooperating with the notch 9 incorporates a first part 15 connected with the drive shaft 12 of the motor, a central part 16 whose edges are intended to cooperate with the oblique planes 14 of notch 9, and a substantially spherical or cylindrical end 10, of a diameter substantially less than or equal to the width of the oblong portion 13 of the notch. Portion 17 is shaped to ensure disengagement to leave the arm 8 sufficient angular clearance. Portion 13 ensures guidance with minimal play of the end 10 of the arm.

The hole 11 is an oblong hole, arranged substantially radially with respect to the curvature of the slider 1. The finger 5 cooperating with the hole 11 includes a spherical head of a diameter substantially less than the width of the oblong hole 11.

Figure 4:
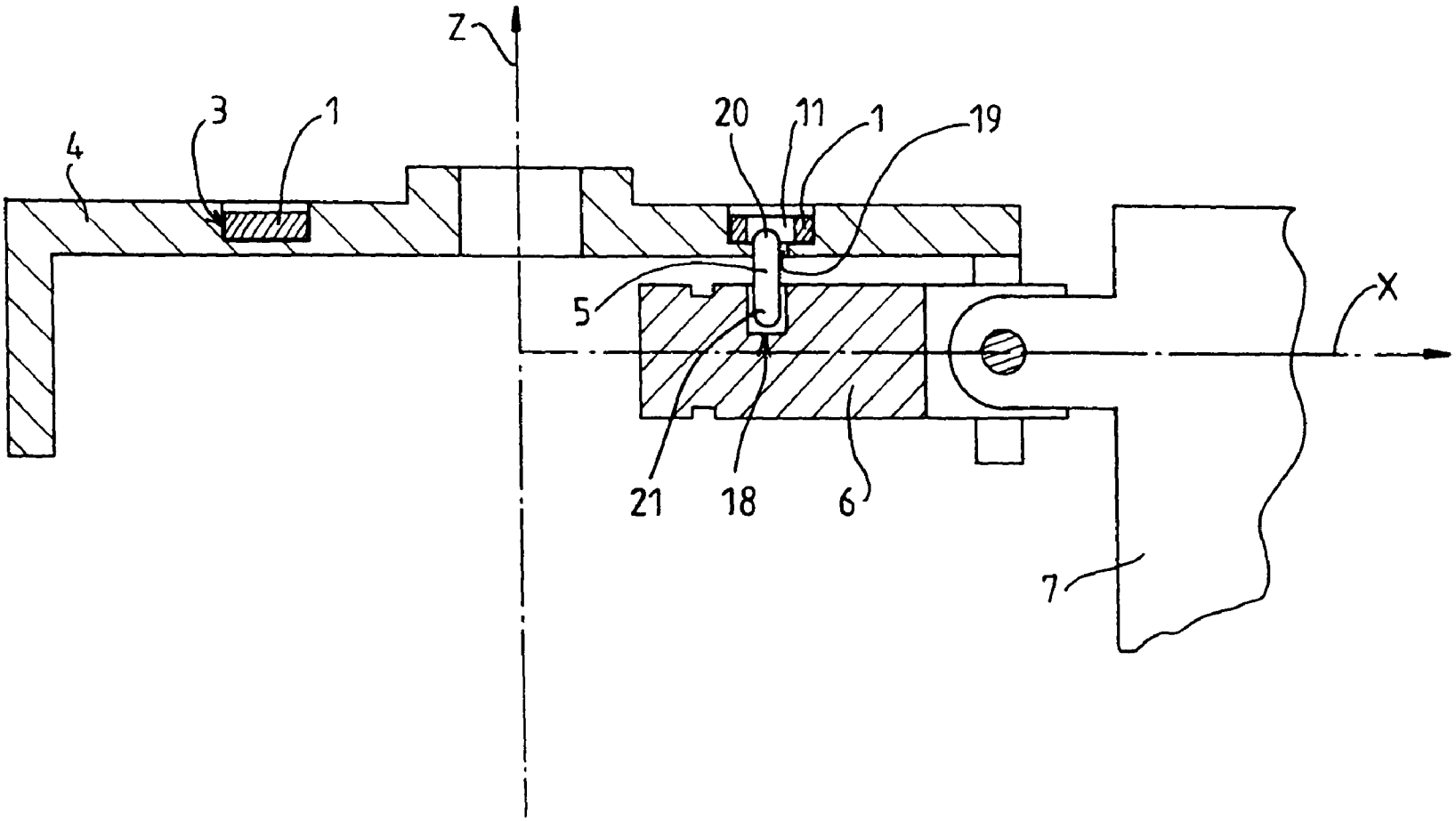
FIG. 4 is a section view of the fin rotation drive device along plane AA of FIG. 1.

FIG. 4 is a section view of the fin rotation drive device along the plane AA shown in FIG. 1. This Figure clearly shows that the sliders 1 are placed at the bottom of the groove 3 in the body 4. As described previously, each slider 1 incorporates an oblong hole 11 with which the upper part 20 of the finger 5 cooperates. The bottom of the groove 3 incorporates drill holes or slots 19 (only one of which can be seen) providing a passage for each finger 5. The fin heads 6 include a housing 18 in which the lower part 21 of the finger 5 is tightly housed (the lower part 21 of the finger may, for example, be screwed into the housing 18). The fin heads 6 are held in the body 4 by a pivot type link (not shown) with an X axis substantially orthogonal to longitudinal axis Z of the projectile.

The device according to the invention operates as follows:

After the projectile has been fired, the fins 7 are deployed and each is connected with the fin head 6. The systems to deploy and secure fin with their heads are sufficiently known to those in this art and thus do not require further description. Reference may be made, however, to French patent FR-2846079 describing such a device which incorporates a spring to ensure the swiveling of the fin 7 with respect to its head 6.

When the projectile trajectory needs to be modified, two opposing motors (or four depending upon the modification required to be made to the trajectory) perform a rotation of their drive shafts 12 along their axes $Z_1$ and $Z_3$ (and/or $Z_2$ and $Z_4$) in opposing directions. The rotation of each shaft 12 causes its slider 1 to slide in the groove 3 by means of the arm 8, whose end 10 presses on the first portion 13 of the notch 9. The opposite pairs of sliders move in the opposite directions about the longitudinal axis Z of the projectile, causing the movement of the upper part 20 of the fingers 5 of the opposite fin heads 6. The slot 19 at the bottom of the groove will be large enough to enable the displacement of the finger 5 when this is driven by the slider 1. The finger 5 is connected with the fin head 6. When the slider 1 moves in its groove, the notch 11 drives the upper end 20 of the finger 5 thereby causing the fin head 6 to swivel.

The fin heads 6 are thus driven in rotation around their spin axis X (or Y) to orient the fins 7. The oblique planes 14 of the notch 9 constitute limit stops limiting the rotation of the fins. Indeed, when one edge of the central part 16 of the arm 8 presses on an oblique plane 14 of the notch, the arm 8 is no longer able to drive the slider 1 and the fin 7 is in its position of maximum orientation.

Figure 5:
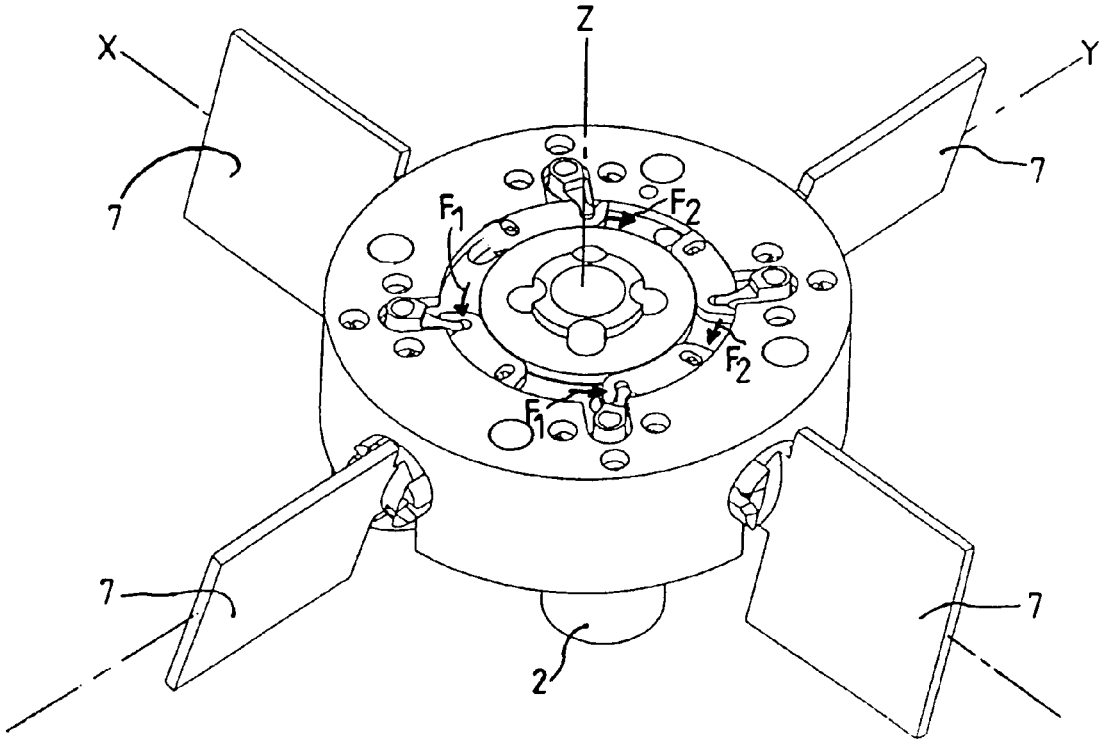
FIG. 5 shows the same device as shown in FIG. 1, but whose fins are in different positions.

FIG. 5 shows the device according to the invention in the configuration where the fins 7 are no longer parallel to longitudinal axis Z of the projectile, but oriented to modify the projectile's trajectory.

In this configuration, the motors 2 have moved the sliders 1 in opposing directions F1 and F2. The sliders acting on the opposing fins have been moved in opposing directions to keep the opposite fins in the same plane.

Advantageously, the circular groove 3 is in a plane that is orthogonal to longitudinal axis Z of the projectile and the slides sliders 1 therefore slide in a plane orthogonal to longitudinal axis Z of the projectile. Such an arrangement has the advantage of being particularly able to withstand a projectile's accelerations along this longitudinal axis Z, namely when it is being fired. In order to also provide good resistance to acceleration for the motors 2, they may be positioned with their axes of rotation substantially in parallel to longitudinal axis Z of the projectile.

The upper end 20 of the finger 5 will preferentially be made in the form of a spherical head to facilitate its cooperation with the oblong hole 11.

The device according to the invention is simple in design. It is particularly easy to machine a single groove in the body 4. This groove provides guidance for the four sliders and ensures the symmetry of the movements.

It is also possible for the length of the sliders 1 to be varied without necessarily modifying the operation of the device and the extent of the invention. Such a variant embodiment of the invention will advantageously enable a fin rotation drive device to be produced whose angular positioning of the motors 2 is uneven.

Figure 6:
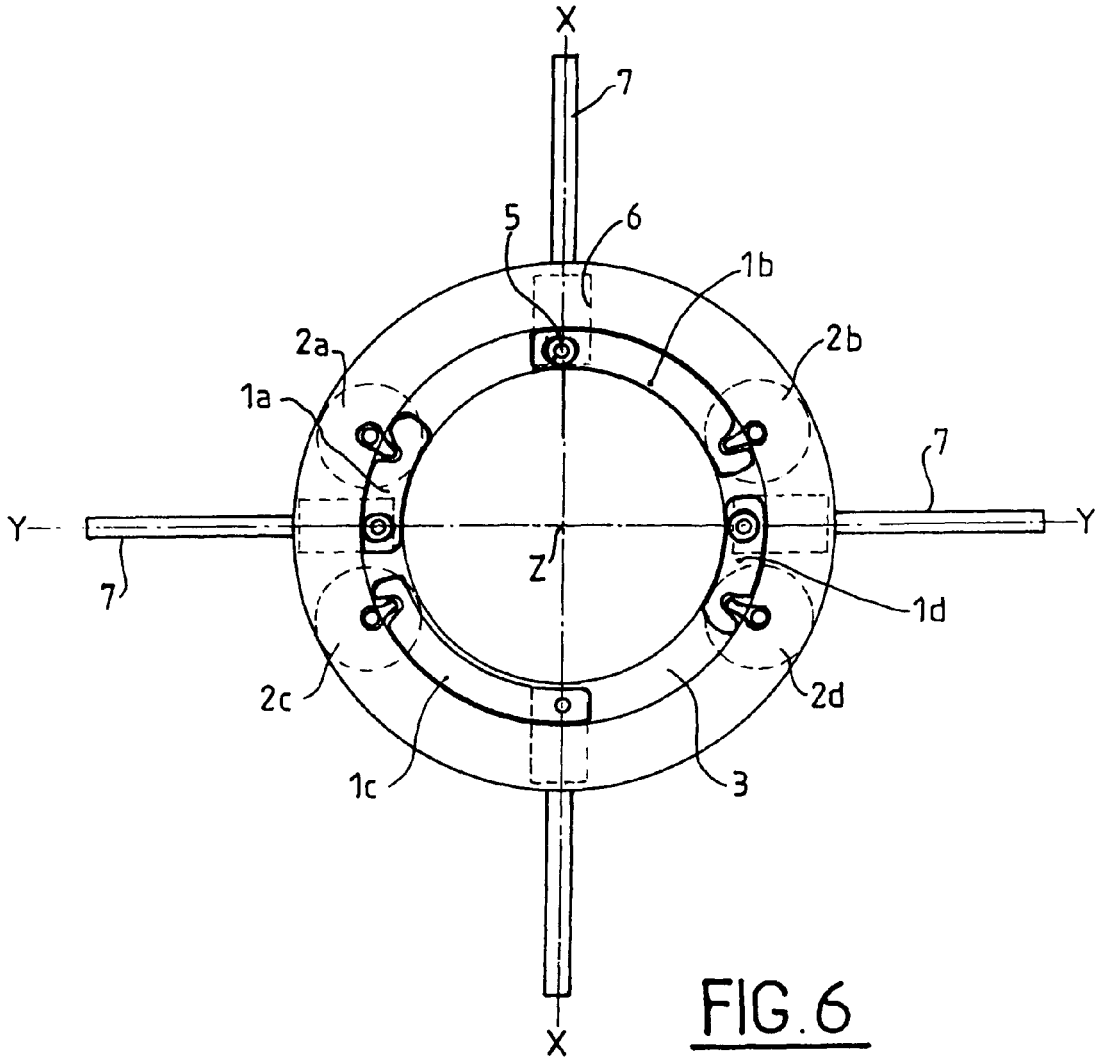
FIGS. 6 and 7 show a top view of variant embodiments of the device according to the invention.

FIG. 6 schematically shows a top view of an embodiment of the invention in which the motors are arranged in pairs. In this variant, the fin drive device incorporates two short sliders 1*a* and 1*d* and two long sliders 1*b* and 1*c*, respectively arranged in opposition with respect to the projectile's longitudinal axis Z. Motors 2*a* to 2*d* are arranged in pairs on either side of the opposing fins 7.

The manufacture and arrangement of the groove 3, fingers 5, fins 7 and fin heads 6 is the same as that described previously.

Such an embodiment of the invention advantageously enables the motors 2 to be integrated in an uneven more compact manner, whilst retaining the device's ability to withstand accelerations. The invention may also be made using sliders which each have a different length, thereby advantageously enabling a non-symmetrical spacing of the motors 2 and easy adaptation to the constraints of integrating motors and electronics into a projectile body. The deployment and control of the fins may thus be symmetrical with motorization arranged in a non-symmetrical manner.

Figure 7:
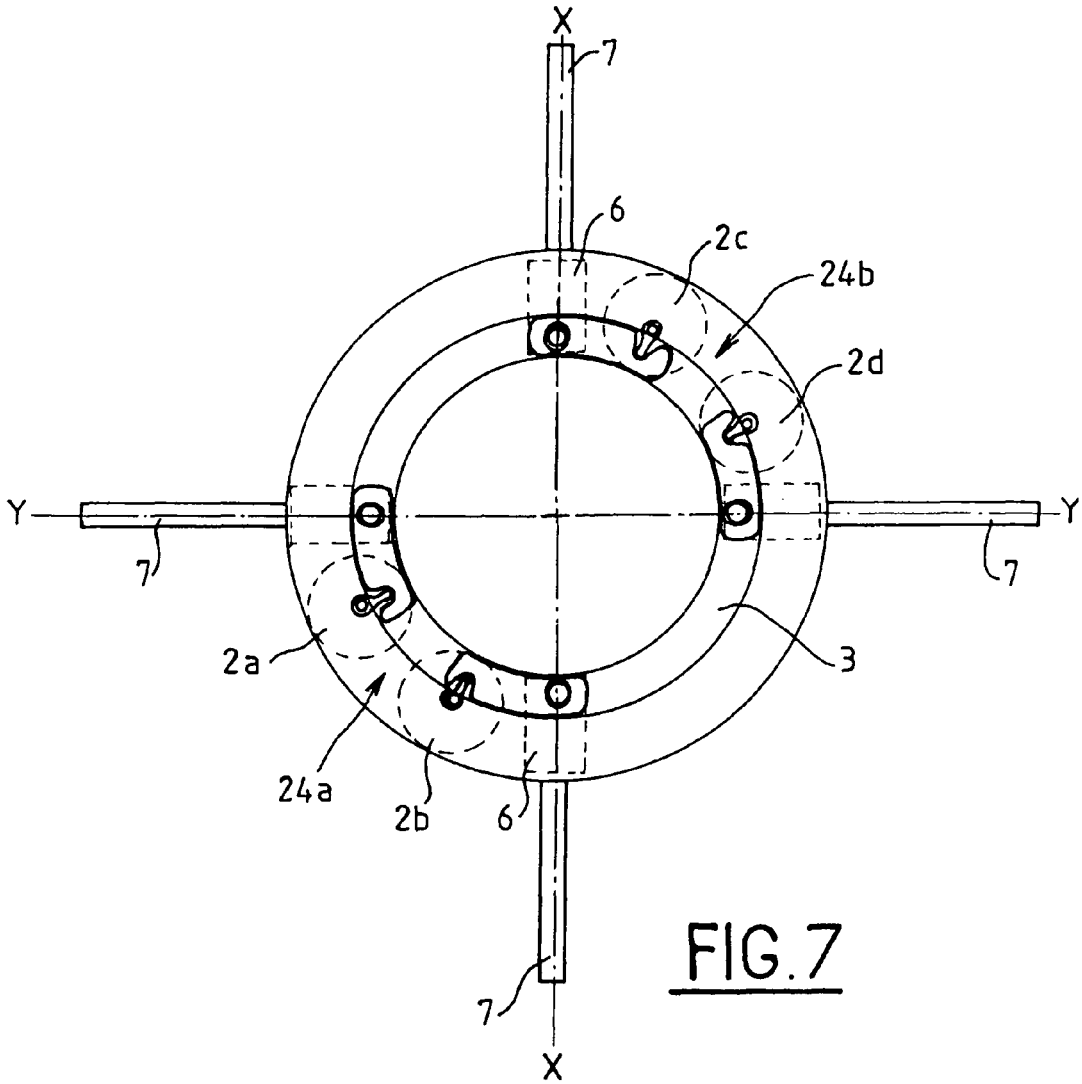

FIG. 7 schematically shows a top view of another embodiment of the invention in which the motors are arranged in pairs. In this variant embodiment, motors 2*a* to 2*d* are arranged in pairs 2*a*-2*b* and 2*c*-2*d* in angular quadrants 24*a* and 24*b* between two fins 7. Such an arrangement advantageously enables a large amount of space to be freed which may then be used, for example, to integrate the onboard electronics or power sources. This embodiment advantageously implements sliders 1 of identical length.

Figure 8:
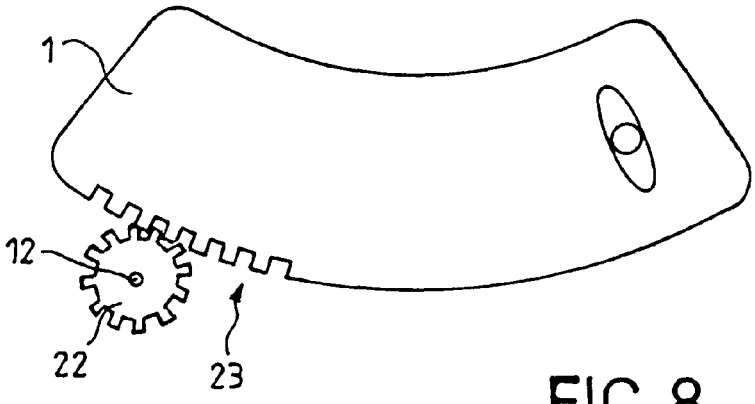
FIG. 8 shows a variant embodiment of the slider and its drive means.

FIG. 8 shows a variant embodiment of the slider and its drive means. In this variant, the notch 9 and arm 8 have been removed. Each slider 1 incorporates a portion of rack 23 onto which meshes a pinion 22 integral with the drive shaft 12 of a motor 2 (not shown). The rack 23 may advantageously and easily be made by machining the slider 1. Rotating the pinion 22 thus causes the slider 1 to slide.

What is claimed is:

1. A device for driving deployable fins of a projectile having a longitudinal (Z) axis, the device comprising:

a body with a central axis (Z') and being connectable to a projectile, with its central axis (Z') generally coinciding with a longitudinal axis (Z) of such a projectile;

rotatable fins extending radially outwardly from the body along spin axes (X', Y') generally orthogonal to the central axis (Z');

motors mounted within the body with the axis of rotation of each motor generally parallel to central axis (Z');

a fin head connecting each fin to only a corresponding one of said motors through a corresponding slider of ring sector shape;

the body having a circular groove therein centered on and orthogonal to central axis (Z') said groove in a plane that is orthogonal to the longitudinal (Z) axis of the projectile; and the ring sector-shaped sliders are located in the circular groove, and each motor is connected to one of the sliders for driving said one slider in the circular groove thereby rotating the fin connected to said corresponding slider.

2. A fin drive device according to claim 1, wherein each of said sliders includes a notch and an arm connected with a drive shaft of said corresponding motors and cooperating with said notch to drive a slider in said groove.

3. A fin drive device according to claim 1, wherein each of said sliders includes a portion of a rack gear onto which meshes a pinion connected with a drive shaft of said corresponding motors.

4. A fin drive device according to claim 1, wherein each of said sliders includes a hole cooperating with a finger connected with one of said fin heads.

5. A fin drive device according to claim 4, wherein the end of each of said fingers cooperating with each of said sliders is spherical.

6. A fin drive device according to claim 5, wherein said motors are positioned angularly in pairs with one motor on each side of each of said fins.

7. A fin drive device according to claim 5, wherein a pair of said motors is positioned in an angular quadrant between two of said fins.

8. A fin drive device according to claim 1, wherein said motors are evenly spaced angularly around said central axis (Z').

9. A fin drive device according to claim 1, wherein a pair of said motors is positioned in an angular quadrant between two of said fins.

* * * * *